US005622143A

United States Patent [19]

Fuoss et al.

[11] Patent Number: 5,622,143

[45] Date of Patent: Apr. 22, 1997

[54] MULTI-CYLINDER INTERNAL COMBUSTION ENGINE

[75] Inventors: Klaus Fuoss, Balingen; Wilhelm Hannibal, Hemer; Michael Paul, Bad Friedrichshall, all of Germany

[73] Assignee: Audi AG, Germany

[21] Appl. No.: 663,296

[22] PCT Filed: Dec. 2, 1994

[86] PCT No.: PCT/EP94/04013

§ 371 Date: Jun. 21, 1996

§ 102(e) Date: Jun. 21, 1996

[87] PCT Pub. No.: WO95/18290

PCT Pub. Date: Jul. 6, 1995

[30] Foreign Application Priority Data

Dec. 24, 1993 [DE] Germany ..... 43 44 501.2

[51] Int. Cl.[6] ..... F01L 1/04; F01L 1/26; F01L 1/344

[52] U.S. Cl. ..... 123/54.4; 123/92.27; 123/92.17

[58] Field of Search ..... 123/54.4, 54.5, 123/54.6, 54.7, 54.8, 70.27, 90.17, 315

[56] References Cited

U.S. PATENT DOCUMENTS

| | | | |
|---|---|---|---|
| 4,674,452 | 6/1987 | Asanomi | 123/90.27 |
| 4,787,342 | 11/1988 | Matsumori et al. . | |
| 4,953,525 | 9/1990 | Sakurai et al. | 123/54.6 |
| 5,205,248 | 4/1993 | Hara et al. | 123/90.17 |
| 5,533,586 | 9/1996 | Koishikawa et al. | 123/54.4 |

FOREIGN PATENT DOCUMENTS

| | | |
|---|---|---|
| 0441167 | 1/1991 | European Pat. Off. . |
| 0518472 | 4/1992 | European Pat. Off. . |
| 2909803 | 3/1979 | Germany . |
| 3831333 | 9/1988 | Germany . |
| 4042415 | 9/1990 | Germany . |

*Primary Examiner*—Marguerite McMahon
*Attorney, Agent, or Firm*—Lalos & Keegan

[57] ABSTRACT

In a multi-cylinder internal combustion engine, the cylinders are disposed in two rows, the cylinders in one row being staggered with respect to the cylinders in the other row and the longitudinal axes of the cylinders in the first row being disposed at an angle to the longitudinal axes of the cylinders in the other row. The outlet valves are located close to the plane of symmetry between the rows of cylinders whereas the inlet valves are located out of this plane. All of the outlet valves of both rows of cylinders are provided with a common centrally located camshaft whereas the inlet valves of each row of cylinders is provided with a dedicated sidelocated camshaft for each row.

5 Claims, 3 Drawing Sheets

38
3
22'
21
16
17
20
22
5'
30
31
32
33
15'
35
2
6'
13
10'
14
15
1
6
5
40
4'
9
8'
10
8
9'
4
39
B
S
A
12
21

MULTI-CYLINDER INTERNAL COMBUSTION ENGINE

FIELD OF THE INVENTION

The invention relates to a multi-cylinder internal combustion engine whose cylinders are arranged in two rows, the cylinders of the first row being staggered relative to the cylinders of the second row.

BACKGROUND OF THE INVENTION

Inlet and outlet valve rows alternate in a state-of-the-art internal combustion engine, that is, in the direction transverse to the longitudinal, a row of outlet valves is followed by a row of inlet valves, a row of outlet valves again, and lastly a row of inlet valves. Two camshafts are provided, an inlet camshaft and an outlet camshaft, which are positioned above the outer valve rows, and each of which actuates the valves of the outer valve row and the valves of the nonadjacent inner valve row. The valves of the inner valve rows are inevitably inclined at a steep angle to the longitudinal axes of the pertinent cylinders, this resulting in an unfavorable shape for the combustion chamber. Moreover, since the length of the inlet and outlet channels of the two cylinder rows varies, there is no certainty that the same admission and combustion conditions are present in all cylinders.

In order to prevent these unfavorable conditions, DE-A 38 31 333 discloses the mounting of inlet valve rows on both sides and near the plane of symmetry extending between the cylinder rows, but the outlet valve rows on the outside of the inlet valves, and provision of a common inlet camshaft for the two inlet valve rows in the plane of symmetry between cylinder rows and provision of an outlet camshaft for each outlet valve row.

As a result, all cylinders have combustion chambers, as well as inlet and outlet valves, of identical design, so that uniform admission and an identical combustion process for all cylinders are ensured. It has been found, however, that cylinder-selective fuel injection, essential for good mixture preparation, cannot be achieved with this internal combustion engine. In addition, intense heating of the intake mixture and the resulting admission loss are unavoidable. Lastly, this design cannot be used for an internal combustion engine with more than two inlet valves, since there is no room on the inlet camshaft common to all the inlet valves for more than two cams per cylinder. Because of these cramped space conditions, the inlet valves can be actuated only by tappets, not by rocker arms.

SUMMARY OF THE INVENTION

An object of the invention is the development of a generic internal combustion engine in which the combustion chambers and the inlet and outlet valves of all cylinders may also be of identical design, but in which cylinder-selective fuel injection may be provided and heating of the mixture admitted kept low without any problem, and, lastly, in which more than two inlet valves may be provided per cylinder.

In the present invention, Since the inlet valve rows are mounted externally to the outlet valve rows, the inlet channels provided may extend obliquely inward from the outside.

This presents the option of providing an injection valve which injects into the appropriate inlet valve or valves. In that the inlet channels are positioned on the outside, heating of the mixture admitted is prevented or, at any rate, reduced.

External positioning of the inlet valve rows yields the additional option of providing long inlet channels with little space required, so that torque is increased in the lower engine speed range. Lastly, since each inlet camshaft actuates the inlet valves of only one cylinder row, more than two cams per cylinder may be mounted on each inlet camshaft, so that, for example, an internal combustion engine with three inlet valves per cylinder can be developed without difficulty. Moreover, in the proposed arrangement of the inlet camshafts there is enough space for actuating the inlet valves even by way of rocker arms. This is a consideration of particular importance, in that the possibility is created of mounting a variable valve control unit, for example as is claimed in DE-A 42 05 230. The present invention also offers the possibility of developing an internal combustion engine optionally with tappet control or control by tappets or rocker arm control for inlet valves.

In order to achieve high output and high torque over the entire engine speed range, the state of the art provides for rotating the inlet camshafts as a function of engine speed in order to achieve optimum admission conditions in all engine speed ranges. While up to the present each inlet camshaft has been provided with an adjustment device of its own, in accordance with another feature of the present invention only a single adjustment device is provided for both inlet camshafts, preferably on the outlet camshaft, which is then powered directly by the crankshaft as the only driven camshaft. Camshaft adjustment devices generally have a drive element powered by the crankshaft and a driven element rotatable relative to the latter. Consequently, the drive element is connected to the outlet camshaft and the driven element to both inlet camshafts, preferably by way of a chain gear, the driven element of the adjusting device and the inlet camshafts having chain gears of the same diameter. The diameter of these chain gears may be considerably smaller than that of the drive gear seated on the outlet camshaft and drive-connected to the crankshaft, as a result of which the overall width of the cylinder head, in determination of which the diameter of the chain gears seated on the inlet camshafts is decisive, is reduced. This is, of course, of particular importance in installation of such an internal combustion engine in the engine compartment of a motor vehicle.

BRIEF DESCRIPTION OF THE DRAWINGS

An embodiment of the invention is described below with reference to the drawings.

Figure 1:
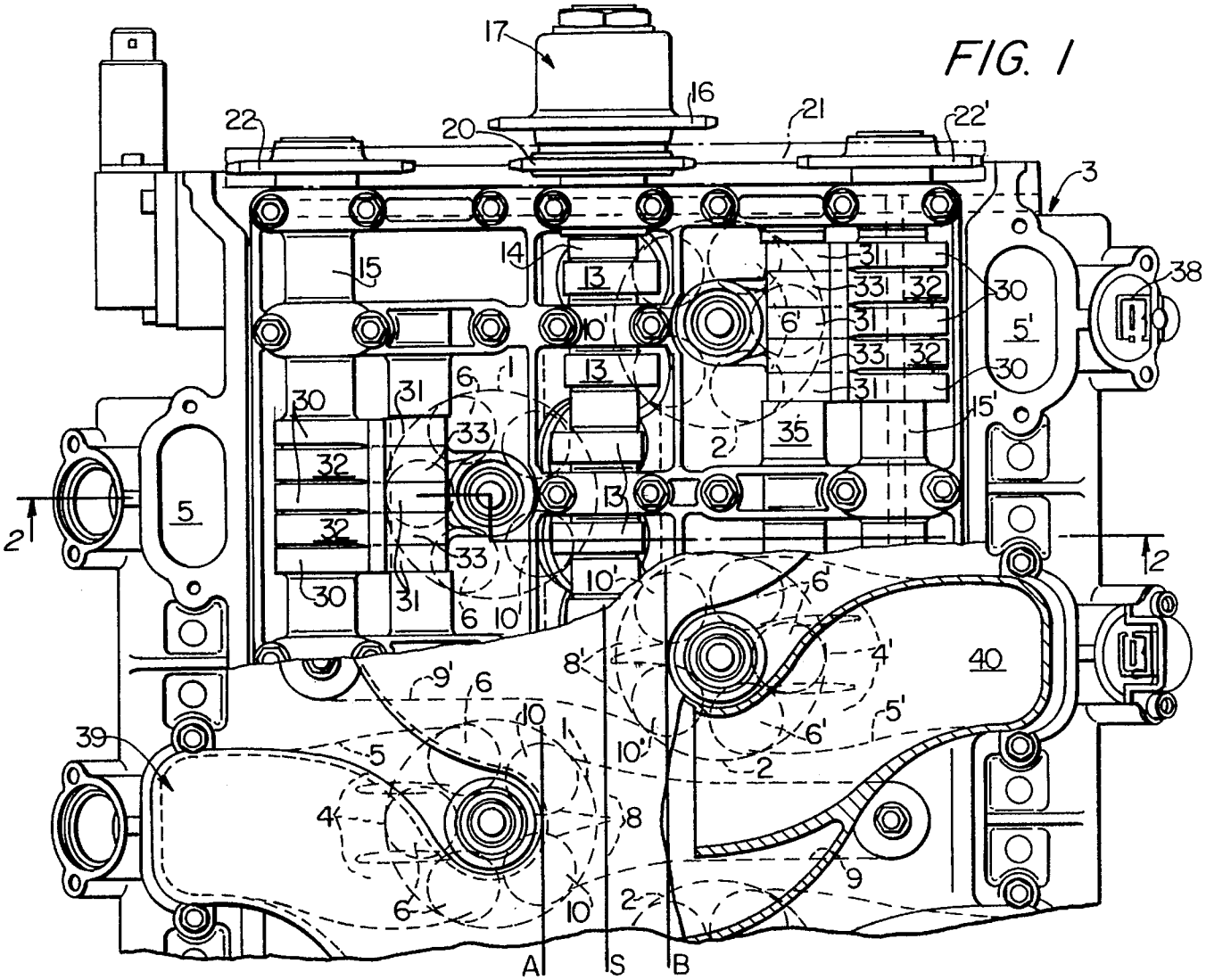
FIG. 1 presents a top view of a section of a cylinder head of a multi-cylinder internal combustion engine, with the cylinder head cover partly cut away.

In the multi-cylinder internal combustion engine shown, the cylinders are arranged in two rows, the cylinders 1 of one row being staggered relative to the cylinders 2 of the other row and the longitudinal center axes of one row forming an angle with the longitudinal center axes of the cylinders of the other row.

For each cylinder 1 of the first cylinder row the cylinder head 3 contains three inlet channels 4, which originate in a collective inlet channel 5 and end in inlet openings 6 controlled by inlet valves 7. Associated with each cylinder 1 of the first cylinder row there are additionally two outlet channels 8, which are combined to form a collective outlet channel 9 and which originate in outlet openings 10 Controlled by outlet valves 11. There are analogously provided for the cylinders 2 of the second cylinder row three inlet channels 4' ending in inlet openings 6' controlled by inlet valves 7' and two outlet channels 8' originating in outlet openings 10' controlled by outlet valves 11'.

The outlet valves 11, 11' of all cylinders 1, 2 are each mounted in two outlet valve rows A and B extending in the longitudinal direction of the engine and positioned on both sides and near the plane of symmetry S extending between the cylinder rows. The outlet valves 11, 11' of both cylinder rows are actuated by way of tappets 12 by the cams of a common outlet camshaft 14, which is located in the plane of symmetry S referred to. The inlet valves 7, 7' of the two cylinder rows are mounted externally of the outlet valves and each is actuated by the cams of inlet camshaft 15 or 15' respectively, positioned on the outside portion of the engine. Mounted on the outlet camshaft 14 is a driving wheel 16 drive-connected to the crankshaft.

Figure 3:
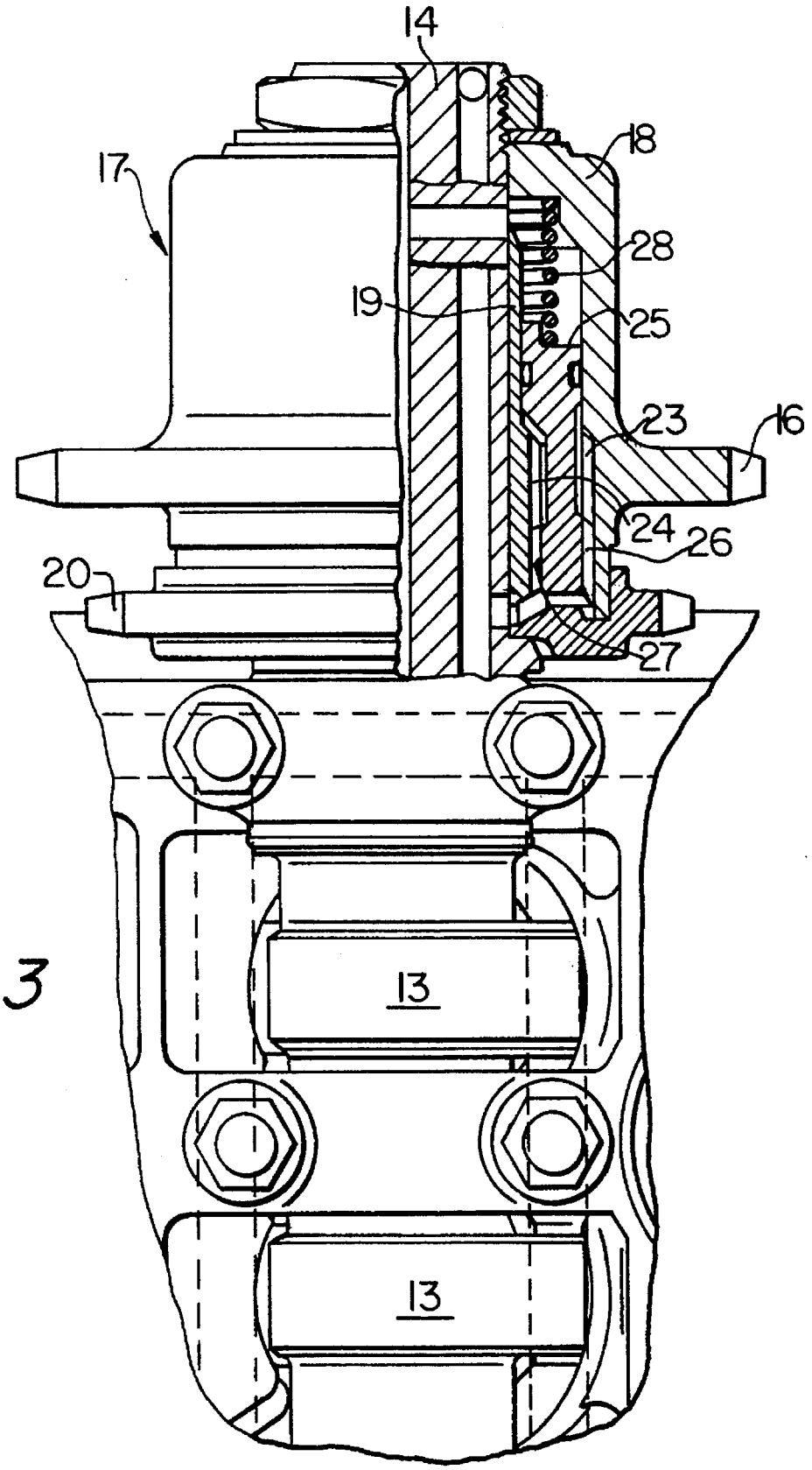
FIG. 3 shows the front end of the outlet camshaft with the adjusting device for the inlet camshafts, partly cut away.

The inlet camshafts 15, 15' are driven in the embodiment described from the outlet camshaft 14, specifically by way of an adjusting device 17 by means of which the angular position of the inlet camshafts relative to the outlet camshaft and also relative to the crankshaft may be modified. This state-of-the-art adjusting device is shown in detail in FIG. 3; it has a sleevelike drive element 18 connected integrally to the drive wheel 16 and nonrotatably to the outlet camshaft 14. The adjusting device also has a driven element 19 mounted rotatably on the outlet camshaft 14 inside the drive element 18; mounted on it is a driven wheel or chain gear 20 drive-connected by a chain 21 to chain gears 22, 22' mounted on the inlet camshafts 15, 15'. The drive element 18 is provided with internal longitudinal cogging 23 and the driven element 19 is provided with external helical gearing. Mounted between the drive element 18 and the driven element 19 is a ring-shaped adjusting piston 25 having straight cogging 26 engaged with the gearing 23 and helical gearing 27 engaged with the gearing 24. The drive element 18 is accordingly nonrotatably connected to the driven element 19. The angular position of the driven element 19 relative to the drive element 18, and accordingly the angular position of the inlet camshafts 15, 15' may be modified by displacing the adjusting piston 25. The adjusting piston 25 is adjusted against the force of spring 28 by application of pressure to the left front surface of the adjusting piston 27. An adjusting device such as this is described, for example, in DE-A 29 09 803.

The inlet valves 7, 7' are actuated in the embodiment described by way of rocker arms, a variable valve control unit being provided whereby different actuation can be effected in a lower and an upper engine speed range. A variable valve control unit such as this is described, for example, in DE-A 42 05 230. For this process there is provided on the inlet camshaft 15 or 15' for each inlet valve 7 or 7' of a cylinder, a first cam 30 for the lower engine speed range, which cam operates in conjunction with a first rocker arm 31 which acts on the pertinent inlet valve 7 or 7'. Between adjacent first cams 30 there is provided for each inlet camshaft a second cam 32 which operates in conjunction with a second rocker arm 33. The first rocker arms may be coupled to the second rocker arms 33 by coupling pins, so that the inlet valves are then actuated as determined by the profile of the second cams 32. All first and second rocker arms 31, 33 for the inlet valves of a cylinder row are mounted on a common shaft 35 containing a channel 36 through which pressure means may be delivered which forces the coupling pins 34 into the coupling position against the force of a spring 37.

Figure 2:
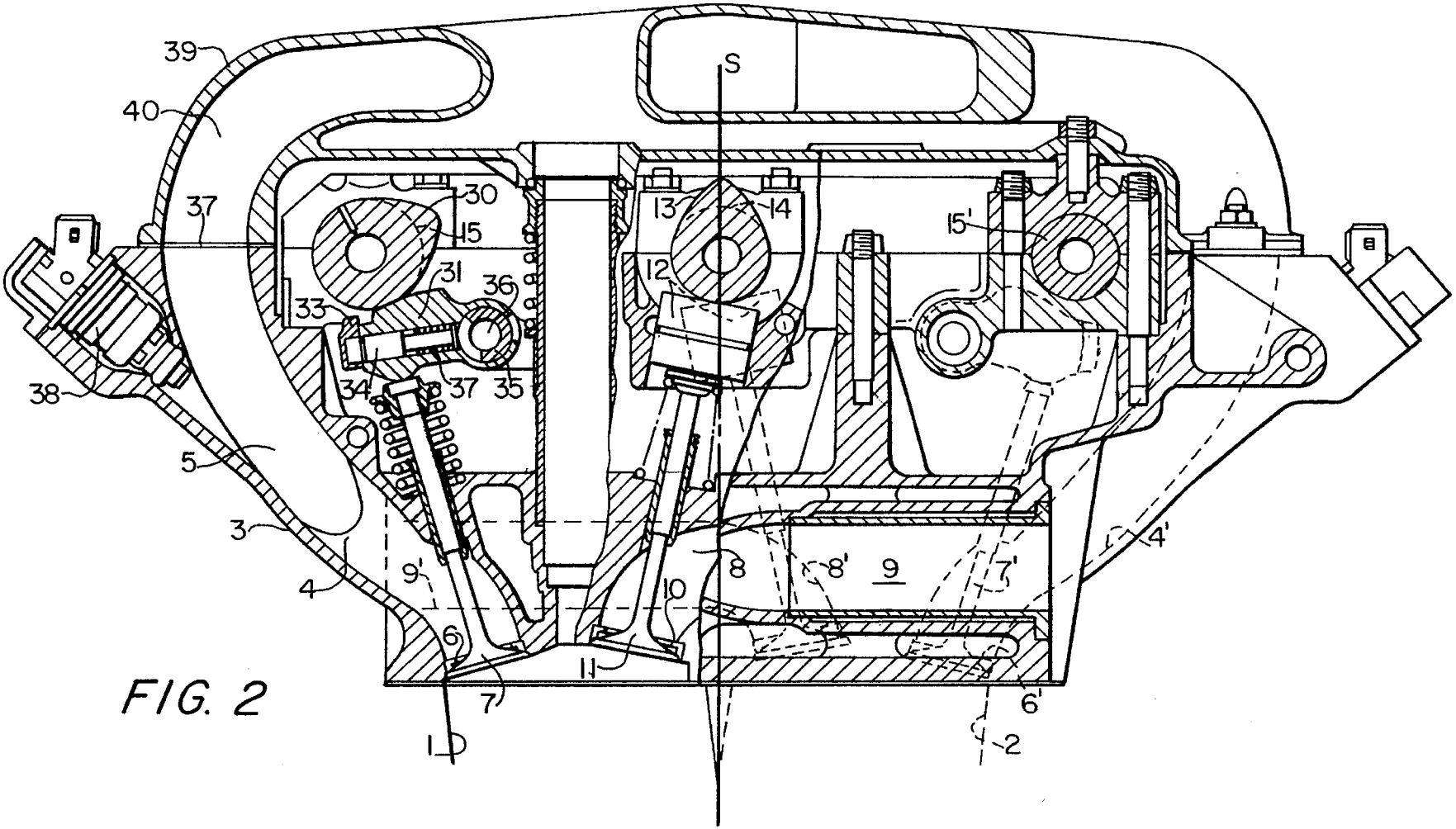
FIG. 2 is a cross-sectional view along line 2—2 in FIG. 1.

As may be seen from FIG. 2, the collective inlet channels 5 extend outward and upward to the top 37 of the cylinder head. Associated with each collective channel 5 is an injection valve 38 which injects in the direction of the three inlet valves 7 or 7'. A cylinder head cover 39 is mounted on the top 37 of the cylinder head 3. The inlet collection channels 5 extend into channels 40 in the cylinder head cover 39, which channels communicate with an intake distributor, not shown.

The chain gears 20 and 22, 22' are of the same diameter. This diameter may be smaller than that Of the outlet camshaft drive gear 16. As a result, the overall width of the cylinder head 3 in the area of the camshaft drive, in determination of which the diameter of the chain gears 22, 22' seated on the inlet camshafts is decisive, is reduced.

We claim:

1. A multi-cylinder internal combustion engine including cylinders (1,2) arranged in two rows, a first row of cylinders (1) being staggered relative to a second row of cylinders (2) and longitudinal center axes of cylinders of one of said two rows forming an angle with longitudinal center axes of cylinders of a second of said two rows;

a cylinder head (3) including for each cylinder at least one inlet valve (7, 7') and at least one outlet valve (11, 11'), an outlet camshaft (14) for actuating said outlet valves and a crankshaft for driving said outlet camshaft, said outlet valves of said cylinders being arranged in two rows (A, B) of outlet valves extending in a longitudinal direction of the engine; and wherein said outlet valve rows (A,B) are situated on both sides of and near the plane of symmetry (S) extending between said cylinder rows and said inlet valves are situated externally of said outlet valves;

and including a common outlet camshaft for said two rows (A, B) of outlet valves, said common outlet camshaft being situated in said plane of symmetry (S), and an inlet camshaft (15, 15') for actuating said inlet valves (7, 7') for each said cylinder row, said inlet camshafts (15, 15') being situated externally of said outlet camshaft;

and including outlet openings (10, 10') on a combustion chamber side of each cylinder and Outlet channels (8, 8') for each cylinder extending from an outlet opening over an adjacent cylinder row to a cylinder head side of said adjacent cylinder row.

2. A multi-cylinder engine as in claim 1 including two outlet channels (8, 8') per cylinder and a collective outlet channel (9, 9') formed from a combination of said two outlet channels per cylinder.

3. A multi-cylinder engine as in claims 1 or 2 including means for driving said outlet camshaft directly by said crankshaft, an adjusting device (17) provided on said outlet camshaft for modifying the angular position of said inlet camshafts (15, 15') relative to said crankshaft, said adjusting device including a drive element (18) nonrotatively connected to said outlet camshaft and a driven element (19)

rotatable relative to said drive element, and a traction gear mechanism (20, 21, 22, 22') for connecting said driven element to said inlet camshafts.

4. A multi-cylinder engine as in claim 3 wherein said traction gear mechanism includes a first chain gear (20) mounted on the driven element and second and third chain gears (22, 22') mounted on the inlet camshafts (15, 15'), said first, second and third chain gears having the same diameter, and a drive wheel (16) connected to said outlet camshaft and drive-connected to said crankshaft and having a diameter larger than said diameter of said first, second and third chain gears.

5. A multi-cylinder engine as in claim 4 wherein said drive wheel (16) connected to said outlet camshaft is mounted on said drive element (18) of said adjusting device (17).

* * * * *

UNITED STATES PATENT AND TRADEMARK OFFICE

CERTIFICATE OF CORRECTION

PATENT NO. : 5,622,143

DATED : April 22, 1997

INVENTOR(S) : Fuoss et al.

It is certified that error appears in the above-indentified patent and that said Letters Patent is hereby corrected as shown below:

Col. 3, line 17, after "15'", insert --,--;
line 46, after "15'", insert --,--;
line 59, after "15'", insert --,--.

Col. 4, line 18, after "that" change "Of" to --of--; and

In Claim 1, line 52, after "and", change "Outlet" to --outlet--.

Signed and Sealed this

Twenty-fifth Day of November, 1997

*Attest:*

BRUCE LEHMAN

*Attesting Officer*

*Commissioner of Patents and Trademarks*